United States Patent [19]

Martin et al.

[11] 4,167,158

[45] Sep. 11, 1979

[54] FUEL INJECTION APPARATUS

[75] Inventors: Barrie J. Martin, Shenfield; Samuel S. Hall, Hornchurch, both of England

[73] Assignee: Plessey Handel und Investments AG, Zug, Switzerland

[21] Appl. No.: 759,476

[22] Filed: Jan. 14, 1977

[30] Foreign Application Priority Data

Jan. 14, 1976 [GB] United Kingdom ..... 1458/76
Apr. 22, 1976 [GB] United Kingdom ..... 16419/76

[51] Int. Cl.[2] ..... F02B 3/00
[52] U.S. Cl. ..... 123/32 EA; 123/32 AE
[58] Field of Search ..... 123/32 EJ, 119 EE, 32 EA, 123/32 AE

[56] References Cited

U.S. PATENT DOCUMENTS

| | | | |
|---|---|---|---|
| 2,908,443 | 10/1959 | Fruengel | 123/119 EE |
| 3,522,794 | 8/1970 | Reichardt | 123/32 EA |
| 3,956,928 | 5/1976 | Barrera | 123/32 EJ |

*Primary Examiner*—Ronald B. Cox
*Attorney, Agent, or Firm*—Fleit & Jacobson

[57] ABSTRACT

Fuel injection apparatus comprising a fuel injector and a surface which can be vibrated, the apparatus being such that in operation the injector is vibrated to inject atomized fuel towards the surface which is also vibrated so that any particles of insufficiently atomized fuel can hit the vibrating surface and be further atomized.

5 Claims, 5 Drawing Figures

FUEL INJECTION APPARATUS

This invention relates to fuel injection apparatus.

Accordingly, this invention provides fuel injection apparatus comprising a fuel injector and a surface which can be vibrated, the apparatus being such that in operation the injector is vibrated to inject atomized fuel towards the surface which is also vibrated so that any particles of insufficiently atomized fuel can strike the vibrating surface and be further atomized.

Various types of injector may be used in the present invention. Preferably, the injector has a ball valve effective to shut-off the fuel flow when the injector is not being vibrated. Examples of appropriate injectors that may be used are described in our U.S. Pat. No. 3,884,417 and G.B. Pat. No. 1,415,539, and in our U.S. Pat. No. 3,949,938 and U.S. Patent Applications Nos. 695,156, 660,929 filed on Feb. 24, 1976, now pending, 596,205 filed on July 15, 1975, now pending, and 715,006 filed on Aug. 17, 1976, now pending.

The injector is preferably a vibratory injector which is vibrated by means of a piezoelectric device but it may also be vibrated by other devices.

Generally, the surface which can be vibrated can form part of any device. The surface can be vibrated by means of a piezoelectric device or an electromagnetic device. The electromagnetic device may be a magnetostrictive device. Preferably, the surface is attached to a vibrating device that can be used as a vibratory fuel injector. In this case, the vibrating device (hereinafter sometimes referred to as a surface atomizer) will be vibrated not to inject fuel but to merely cause the surface to vibrate. The surface can be, for example, on a flat plate arranged around the neck of the surface atomizer. In one preferred embodiment of the invention, the plate takes the form of a disc which is sufficiently thin such that when the disc is vibrated, the vibrations are in the longitudinal plane of the disc. As the thin plate vibrates, a plurality of vibration anti-nodes are formed on the plate between its centre and its edges. A single vibrating device can thus be used to provide a large vibrating surface having a plurality of areas of maximum vibration, i.e., the anti-nodes, without using too much power. Obviously, if desired, the disc could be made thicker and/or more rigid in which case the vibrations would tend to be at right angles to the plane of the disc and there would only be one vibration anti-node.

In one embodiment of the invention, the fuel injection apparatus is modified to provide apparatus for metering fuel and air for an engine, the apparatus then including air flow measuring means which measures at least a part of the flow of air for the engine and which generates an electrical output that is proportional to the measured air flow, and control means which receives the output from the air flow measuring means and which generates electrical output signals which vary in dependence upon the received signals, the apparatus being such that in use the output signals from the control means are used to control the period of vibration of at least the injector. Preferably, the output signals from the control means are used to control the period of vibration of the injector and the surface.

The apparatus of the invention can be effective for providing an optimum amount of fuel and air for an engine under varying conditions. Precise control is achieved by utilising the air flow for the engine. More specifically, the use of the air flow measuring means enables a continuous check on the condition of the air ultimately destined for an engine. The data obtained by the air flow measuring means can then be fed to the control means and the control means can then appropriately control the injection of fuel into the air. The presence of the surface which can be vibrated ensures that the injected fuel is in a finely atomized form so that it can be fully mixed with the air.

The apparatus of the present invention may be used for various types of engines such for example as two and four stroke internal combustion engines.

Usually the output from the air flow measuring means will be a series of electrical pulses of a frequency determined by the air volume flow through the air flow measuring means. Preferably, the air flow measuring means is a vortex shedding flow meter having a pressure or a temperature transducer. Such a vortex shedding flow meter may have a bluff body which causes the air passing the bluff body to form vortices alternatively from either side of the bluff body. The oscillation within the air flow can then be sensed by the pressure or temperature transducer. Other types of apparatus can be used if desired such for example as air flow measuring means which gives an output dependent upon temperature changes caused by varying air flow. Still further, the air flow measuring means may be a fluidic device, e.g. a fluidic switching device in which the air switches between two channels.

The air flow measuring means may be arranged in the main air duct leading to the engine. In this case, all the air for the engine is measured. Alternatively, the air flow measuring means can be arranged in a by-pass air duct so that only a proportion of the air for the engine is measured. In this latter case, the fuel is preferably injected into the main air duct but, if desired, it can be mixed with the air in the by-pass duct and then this mixture can be combined in the main air duct with the remaining flow of air destined for the engine prior to the introduction of the fuel/air mixture into the engine.

Advantageously, the injector and the surface to be vibrated are both positioned in the vicinity of an inlet manifold for an engine. Since the fuel injector and the surface are positioned in the vicinity of the inlet manifold, the fuel does not have to pass along an appreciable length of an air induction pipe leading to the inlet manifold. It can sometimes be disadvantageous to inject the fuel in the air induction pipe an appreciable distance from the inlet manifold since the fuel will obviously wet the walls of the induction pipe. When the engine is being driven and power is no longer required, the operator will release the throttle to cause the engine revolutions to subside and a correspondingly smaller amount of fuel to be injected from the injector. This may often cause a suction effect at the inlet manifold which can act to suck the petrol off the walls of the induction pipe and into the engine at a time when this additional fuel is not required. By appropriately positioning the injector and the surface to be vibrated near the inlet manifold, this disadvantageous effect can be substantially prevented.

The control means may be a digital computer device. An analogue computer device may also be used. Preferably, the control means actuates the injector on a predetermined pulse width per signal.

The control means may include a monostable device effective to receive the pulses from the air flow measuring means and to generate pulses of an appropriate predetermined pulse width. The monostable device may have a fixed multiplication or division factor so that it is able to generate output pulses which are in a fixed ratio to the input pulses. The width of the pulses can be altered to enable the air/fuel ratio either to be kept constant when the air temperature may be causing variations in the air mass flow, or to be varied (e.g. by using the engine throttle) to enable the engine to respond to transient demands made upon it. The air/fuel ratio can be enriched for engine accelerations and weakened for engine decelerations and on over-run. The air/fuel ratio can also be adjusted for other varying engine conditions such for example as when the temperature of any coolant for the engine varies or when the output of any battery associated with the engine drops too low. If desired, the apparatus of the invention may also include an oxygen sensor which may be located in the exhaust duct from the engine. This oxygen sensor may provide a feedback signal from the engine exhaust to the control means and may be effective to ensure that the fuel supplied to the engine is correct to maintain a desired optimum air/fuel ratio, e.g. 15:1 by mass.

The output pulses from the monostable device may be fed to an oscillator which is effective to actuate the fuel injector and cause it to vibrate. Various types of oscillator and associated circuitry may be utilised and an example of one suitable oscillator and associated circuitry is described in our co-pending U.S. Patent Application No. 723,668, now abandoned.

A solenoid operated valve may also be employed. If desired, the surface atomizer may be similar to or the same as the fuel injector but provided with a surrounding surface which can be used for breaking up any particles of insufficiently atomized fuel. This surface atomizer can also be caused to vibrate by the same type of oscillator and associated circuitry used for vibrating the fuel injector.

It may be necessary due to the practical problems such for example as slow injector valve closing or poor metering accuracy at low pulse widths, for the ratio of injector pulses to air flow meter pulses to be varied at predetermined flow meter rates and to have the pulse width varied accordingly. For example, 1 injector pulse per induction stroke of an engine at idle conditions may require a 1 millisecond pulse on the injector. At high loads, 1 induction stroke may require 5 of the 1 millisecond pulses. At this point, the control means could be set such that it changes the ratio from 1:1 to 1:5 with the pulse width increased to 5 milliseconds, providing the flow from the injector is proportional. If the flow from the injector is not proportional, then the pulse width is adjusted and not the ratio.

Embodiments of the invention will now be described solely by way of example and with reference to the accompanying drawings in which.

Figure 1:
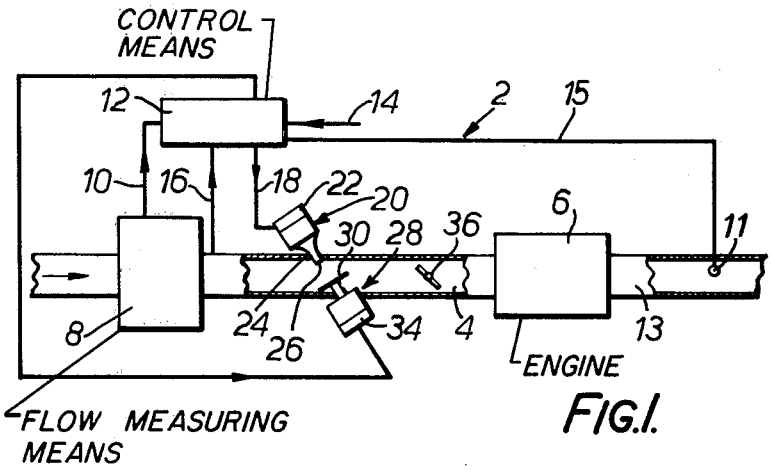
FIG. 1 shows first apparatus in accordance with the invention for metering fuel and air for an engine.

Referring now to FIG. 1, there is shown apparatus 2 for metering fuel in accordance with air in an air duct 4 leading to an engine 6. The apparatus 2 comprises air flow measuring means 8 which is arranged directly in the duct 4 and which therefore measures all of the air flow for the engine 6. The measuring means 8 causes an oscillation of the air to be set up with the frequency of oscillation being proportional to the air flow rate. These oscillations are converted into electrical pulses by means of a pressure or flow sensitive element forming part of the measuring means 8. The measuring means 8 thus generates electrical pulses of a frequency proportional to the measured air volume flow.

At cranking speed, the air being inspired into the engine may not be of sufficient velocity to enable the air flow measuring means to work adequately. At these conditions the injector may be commanded by the ignition pulses of the engine. When the output, e.g. air pulses, from the air flow measuring means are of a sufficient frequency, the electrical circuit will sense this and will change the command from the ignition pulses to the air flow measuring means.

The output from the measuring means 8 passes along line 10 to control means 12. The control means 12 is also fed with information such for example as acceleration of the engine via line 14, air temperature in the duct 4 via line 16, battery output voltage via line 17, and engine coolant temperature via line 19. The air and engine coolant temperatures can be measured by appropriately positioned thermistors. When the engine is cold, more fuel may be needed, thus providing a "choke" function. When the vehicle is accelerating, more fuel may temporarily be needed to ensure freedom from engine flat spots. This may be accomplished by a throttle movement rate sensor, which ensures that the fuel:air ratio is increased whenever the vehicle driver demands an acceleration by causing appropriate electrical signals to pass along the line 14.

The control means 12 is thus fed with information which is relevant to the proportion of fuel to air needed by the engine. The control means 12 then generates an appropriate train of square pulses of predetermined width along line 18 which is effective to cause injection of exactly the right amount of fuel into the duct 4 from an injector 20. The width of the pulses is primarily determined by the air flow rate in the duct 4, but modified by the above mentioned control parameters such for example as engine acceleration and air and engine coolant temperatures.

The width of the pulses may also be modified by the optional presence of an oxygen sensor 11 arranged in the exhaust duct 13 of the engine 6. The oxygen sensor 11 monitors the oxygen content of the exhaust and is effective to provide a signal in line 15 indicative of the air/fuel ratio at which the engine is operating. This signal is fed via the line 15 to the control means 12 and may serve to specify the required air/fuel ratio. During acceleration and deceleration of the engine 6, the signal from the oxygen sensor 11 will normally be over-ridden by the throttle movement sensor so that temporary changes in the air/fuel ratio are permitted. This ensures that full driveabilitity of the vehicle is maintained when acceleration is demanded and that minimum fuel is provided during deceleration demands.

The injector 20 is a vibratory type of injector and the line 18 is connected to a piezoelectric crystal 22 forming part of the injector. The electric signals actuate the piezoelectric crystal 22 and the injector is caused to vibrate. Fuel injected by the injector when it is being vibrated is in the form of a spray. The vibrations, which are preferably ultrasonic, are magnified in the horn portion 24 of the injector 20. Usually the tip 26 of the horn portion 24 will have an orifice therein which is closed by means of a non-return valve. Preferably the non-return valve is a ball valve. When a ball valve is used, it is preferably positioned in a separate housing in the nozzle tip 26 and this housing may be provided with various apertures for causing the fuel to swirl in the housing and also be causing the ball valve to be pushed by the fuel in the housing towards the nozzle orifice.

It will be seen from FIG. 1 that positioned adjacent the nozzle 20 and arranged in the duct 4 is a surface atomizer 28. The surface atomizer 28 is provided with a flat plate, disc or collar 30 which receives any insufficiently or non-atomized fuel from the injector nozzle 20. In other respects, the surface atomizer 28 may be substantially the same as the injector nozzle 20 although it will of course not be used for injecting fuel. The surface atomizer is caused to vibrate, usually in synchronisation with the nozzle 20, by the control means 12 which is connected by line 32 to a piezoelectric crystal 34 forming part of the surface atomizer 28. As the surface atomizer 28 is vibrated, any insufficiently or non-atomized fuel which strikes the plate, disc or collar 30 is broken up under the impact. By applying the vibrations to the centre of the plate 30 such that there is an impedance match between the horn and the plate 30, the plate 30 will vibrate in a radial bending mode (i.e., in its own plane) such that an appreciable area of the plate 30 will exceed the level of amplitude at which atomization of fuel on the plate 30 takes place. The vibrating plate will have a plurality of anti-nodes between its centre and its edges. The edge of the plate 30 will be at a vibration anti-node and this ensures that any fuel in the centre of the plate 30 that runs towards the edges of the plate and is not vibrated still has the chance of being vibrated right at the edge of the plate 30.

If desired, a plate, collar or ring can also be provided on the nozzle 20 so that fuel particles can be thrown backwards and forwards between the plates, collars or rings until sufficient atomization of the fuel has been achieved.

The fully vapourised and correctly mixed fuel/air mixture can then pass through a normal butterfly throttle 36 to the engine 6 for combustion.

Figure 2:
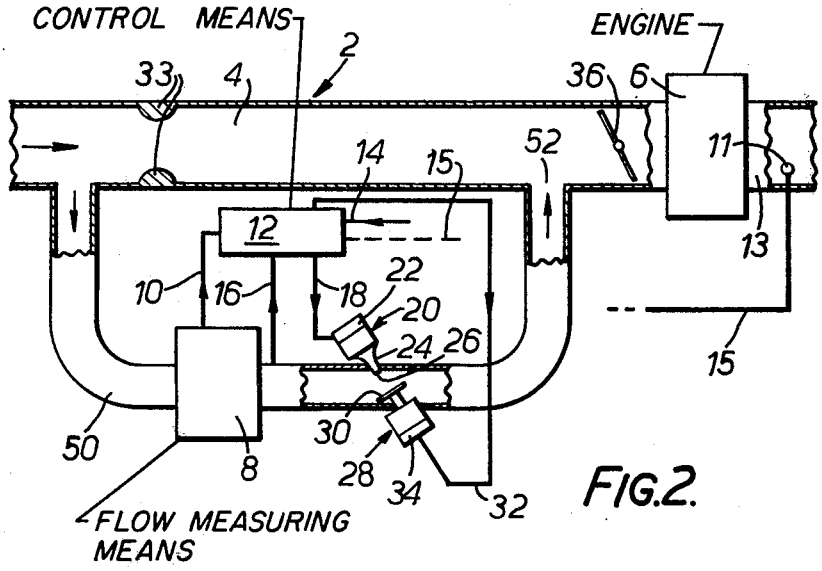
FIG. 2 shows second apparatus in accordance with the invention for metering fuel and air for an engine.

Referring now to FIG. 2, similar apparatus to that shown in FIG. 1 has been illustrated and similar parts have been given the same reference numeral. In the embodiment shown in FIG. 2, it will be seen that the air flow measuring means 8 is not positioned in the main air flow duct 4 but is positioned in a by-pass duct 50. The air flow measuring means 8 thus measures a proportion of the air ultimately destined for the engine 6.

The injector 20 and the surface atomizer 28 are also positioned in the duct 50. The full amount of fuel needed for the engine 6 is injected by the injector 20 into the air in the duct 50. The presence of the surface atomizer 28 ensures that the fuel is fully atomized. The mixture of fuel and air is then passed back into the main duct 4 at orifice 52 and the correct air/fuel mixture then passes past the butterfly throttle 36 to the engine 6. A restrictor 33 may optionally be employed in the duct 4 for ensuring that there is a constant ratio of the air flow through the main duct 4 and the by-pass duct 50.

Figure 3:
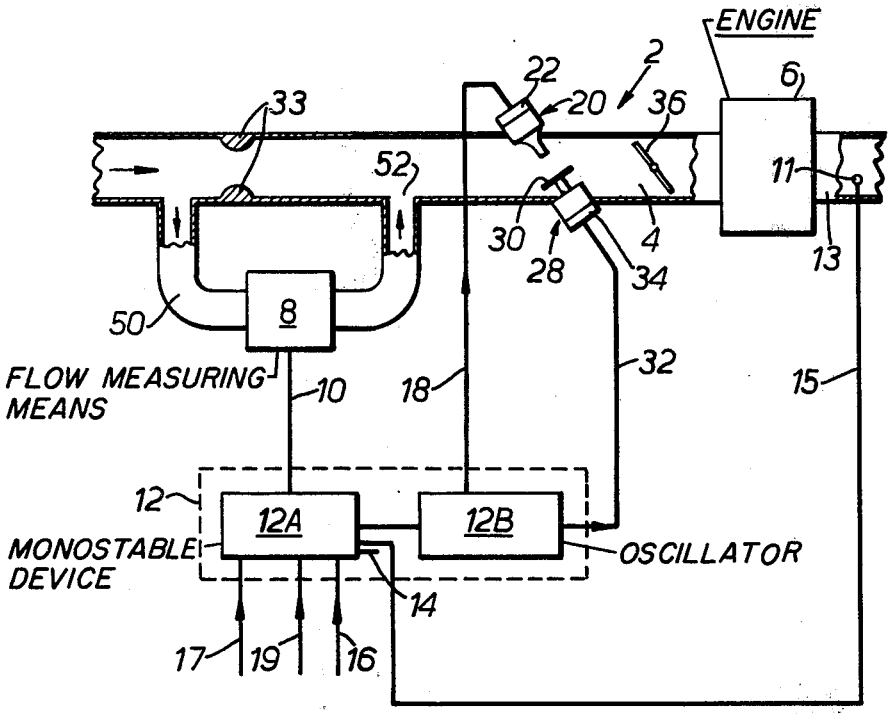
FIG. 3 shows third apparatus in accordance with the invention for metering fuel and air for an engine.

Referring now to FIG. 3, similar apparatus to that shown in FIGS. 1 and 2 has been illustrated and similar parts have been given the same reference numeral. In the embodiment shown in FIG. 3, it will be seen that the air flow measuring means 8 is positioned in the by-pass duct 50 but the injector 20 and the surface atomizer 28 are positioned in the main duct 4.

In the embodiment of FIG. 3, it may be desired to obtain a ratio of 16:1 or 17:1 of air mass:fuel. Also, the pulses passing along line 18 for actuating the injector 20 may be 1 millisecond pulses at engine tick over speeds.

In FIG. 3, it will be noted that the control means 12 has been formed as two separate units comprising a monostable device 12A and an oscillator 12B, e.g. of the type described in our co-pending patent application No. 38470/75 corresponding to U.S. application Ser. No. 723,668, now abandoned. The monostable device 12A is fed with electrical pulses from the air flow measuring means 8, the frequency of the pulses being determined by the mass of air in the bypass duct 50. The monostable device 12A is also fed with information that can affect the fuel/air ratio of the combustion mixture for the engine 6. This information can be information on throttle movement via line 14, air temperature in the duct 4 via line 16, battery output voltage via line 17 and engine coolant temperature via line 19. The monostable device 12A is effective to digest the information received and to generate a train of pulses of predetermined width and of a frequency which fires the oscillator 12B for the required periods of time. The injector 20 injects fuel for the required periods of time consequent upon being activated by the oscillator 12B.

When the systems illustrated in FIGS. 1 to 3 are operated without the oxygen sensor 11, electrical shaping circuits will preferably be included in the control means to ensure that the desired fuel quantity is supplied irrespective of non-linearities within any monitoring instruments or the engine 6.

Figure 4:
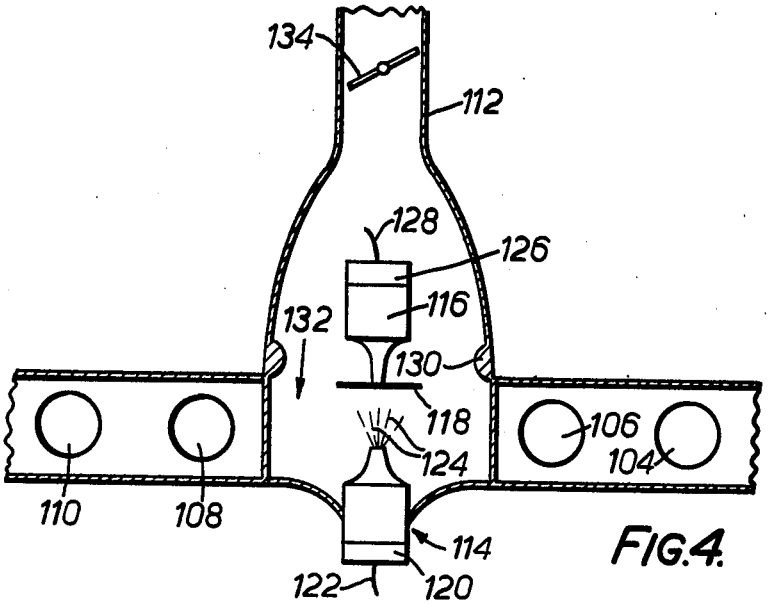
FIG. 4 shows fourth apparatus in accordance with the invention for injecting fuel into an engine.
Figure 5:
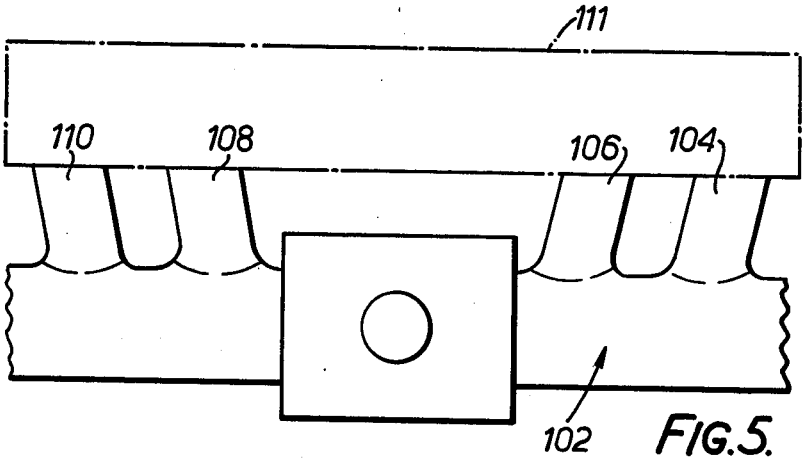
FIG. 5 is a top plan view of the apparatus shown in FIG. 4.

Referring now to FIGS. 4 and 5, there is shown an inlet manifold 102 having inlet pipes 104, 106, 108, 110, leading to an engine 111. Arranged in the inlet manifold 102 is an air induction pipe 112. In the induction pipe 112 and also in the vicinity of the inlet manifold 102, is arranged a fuel injector 114 and surface atomizer means 116 having a surface 118 which can be vibrated.

The injector 114 comprises a piezoelectric ceramic device 120 which can be activated by an electrical current passing along lead 122. Activation of the device 120 causes the injector 114 to vibrate and a ball valve (not shown) inside the injector 114 to be moved off its seat (not shown) to allow fuel to be injected as shown by the dotted lines 124. Small finely divided particles of fuel are carried away by the air passing along the inlet duct 112 to the engine 111 via the inlet pipes 104, 106, 108, 110. Large particles of fuel which are not so carried away by the air strike the plate 118.

The plate 118 is caused to vibrate in the longitudinal plane of the plate by virtue of the fact that the device 116 is being vibrated by a piezoelectric ceramic device 126 energised from a lead 128, and also by virtue of the fact that the plate 118 is sufficiently thin to allow these vibrations to take place. The large particles of fuel hitting the plate 118 are thus projected back into the main air duct after being further broken up by the impact with the plate 118.

It will be noticed that the inlet pipe 112 is provided with an inward restriction 130 in effect forming a Venturi at 132 between the restriction 130 and the edges of the plate 118. Air passing along the pipe 112 past the butterfly 134 is caused to increase in velocity at this point to enable it more efficiently to pick up fuel from the injector 114.

Since the fuel is not injected in the pipe 112 remote from the manifold 102, there will be no fuel in the pipe 112 and it will thus be substantially dry. The fuel will only wet the inlet manifold walls. Thus, when the engines revolutions are suddenly cut back, any suction created in the inlet manifold 102 will not cause fuel to be sucked off the walls of the pipe 112, as would be the case if the fuel were injected in the pipe 112 remote from the manifold 102.

It is to be appreciated that the embodiment of the invention described above has been given by way of example only and that modifications may be effected. Thus, for example, a different type of surface atomizer 28 or 116 could be employed. Also, the inlet manifold 102 in FIGS. 4 and 5 could be heated, for example by means of water, to facilitate fuel atomization. Further, a different type of injector 20 or 114 could be utilised. Thus, for example, the injector could be electro-magnetically operated or could be one without a ball valve. Although only one injector has been shown, more injectors could be employed if desired. For example, in the case of a V-8 engine, two injectors could be employed, each feeding an intake manifold for four cylinders. Still further a low flow rate injector could be employed for one part of an engine cycle and a high flow rate injector could be employed in the same system but for a different part of the engine cycle.

What we claim is:

1. A fuel injection apparatus for an engine of a vehicle comprising a fuel injector positioned in a duct of the engine, a thin plate defining a surface positioned in the duct of the engine to receive fuel injected from the fuel injector, means for vibrating said fuel injector for injecting atomized fuel toward the surface of said thin plate, means for vibrating said thin plate wherein the vibrations are in the longitudinal plane of the plate, said thin plate being sufficiently thin so that said vibrations are in the longitudinal plane of the plate, wherein fuel particles that are insufficiently atomized by the fuel injector are further atomized by the vibrating surface of said plate, air flow measuring means comprising a vortex shedding flow meter which measures at least a part of the flow of air for an engine and which generates an electrical output that is proportional to the measured air flow, and wherein said means for vibrating said fuel injector comprise control means which receives the output from the vortex shedding flow meter and which generates electrical output signals which vary in dependence upon the received signals, means for interconnecting said control means with said injector for activating the injector by a number of times in any given period directly proportional to the number of vortices shed by the vortex shedding flow meter, and fuel dissipating means for dissipating at least a part of the injected fuel.

2. Fuel injection apparatus according to claim 1 in which the flow meter includes a pressure transducer.

3. Fuel injection apparatus according to claim 1 in which the flow meter includes a temperature transducer.

4. Fuel injection apparatus according to claim 1 in which the control means includes a monostable device effective to receive the pulses from the air flow measuring means and to generate pulses of a predetermined width, and in which the control means also includes an oscillator for receiving pulses from the monostable device and for actuating the fuel injector.

5. The fuel injector apparatus of claim 4 wherein said means for vibrating said thin plate comprises said control means and means for interconnecting said control means to said thin plate.

* * * * *